US006453866B1

(12) United States Patent
Altmann et al.

(10) Patent No.: US 6,453,866 B1
(45) Date of Patent: Sep. 24, 2002

(54) MOISTURE EXCLUDING AIR INTAKE SYSTEM FOR AN INTERNAL COMBUSTION ENGINE

(75) Inventors: Klaus Altmann, Boennigheim; Andreas Epp; Thomas Haubold, both of Marbach; Klaus Lieb, Backnang; Jochen Linhart, Waiblingen; Hermann Maurer, Oberstenfeld; Juergen Werner, Baltmannsweiler, all of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/983,825

(22) Filed: Oct. 26, 2001

(30) Foreign Application Priority Data

Oct. 26, 2000 (DE) ..... 100 53 149

(51) Int. Cl.[7] ..... F02M 36/10
(52) U.S. Cl. ..... 123/184.21; 123/198 E
(58) Field of Search ..... 123/184.21–184.61, 123/198 E

(56) References Cited

U.S. PATENT DOCUMENTS 4,726,329 A * 2/1988 Atkin ..... 123/184.34
5,143,038 A * 9/1992 Dahlgren et al. ..... 123/184.54
6,216,657 B1 * 4/2001 Paffrath et al. ..... 123/184.53

* cited by examiner

*Primary Examiner*—Marguerite McMahon
(74) *Attorney, Agent, or Firm*—Crowell & Moring LLP

(57) ABSTRACT

An intake system for an internal combustion engine of a motor vehicle which includes a first unfiltered air intake (10) which is arranged at a location in the vehicle that is favorable for air intake, and a second unfiltered air intake (11) which is arranged at a location in the vehicle that is protected against road spray and splashes of water. The two unfiltered air intakes (10, 11) each open into a common line (12) which communicates with the internal combustion engine. In the first unfiltered air intake (10) there is a moisture sensor (14) which emits a signal when water enters the first unfiltered air intake (10). This signal actuates a drive member 23 which moves a flap 13 between first and second switching positions. In the first switching position, the flap 13 closes the second unfiltered air intake 11, so that no air can get into line 12 from the second unfiltered air intake 11. In the second position, the flap 13 closes the first unfiltered air intake 10, so that air gets into line 12 exclusively through the second unfiltered air intake 11.

12 Claims, 6 Drawing Sheets

MOISTURE EXCLUDING AIR INTAKE SYSTEM FOR AN INTERNAL COMBUSTION ENGINE

BACKGROUND OF THE INVENTION

The invention relates to an air intake system for an internal combustion engine of a motor vehicle.

German patent application no. DE 196 13 860 discloses an air intake filter unit for a motor vehicle engine, which has an unfiltered space that is connected to intake lines with a main intake and a secondary intake. Furthermore, a closing device is provided, which can alternately close one intake line and open the other intake line. This closing device is moved by an actuating element such that the closing device closes the main intake and opens the secondary intake if the motor vehicle dips into water. This actuating element is operatively linked with a slide valve. The slide valve is arranged inside a pipe open at its lower end and is sealed with respect to said pipe. The slide valve is operatively linked with a permanent magnet. The closing device is operatively linked with an additional permanent magnet. The permanent magnet of the closing device is rotatably arranged in relation to the permanent magnet of the actuating element.

The drawback in this device is the substantial amount of space required for the pipe, which is arranged in the engine compartment. The pipe cannot be designed too small since otherwise the changeover point of the arrangement cannot be exactly defined. Furthermore, this mechanical switching arrangement responds only if the vehicle dips into standing water. Road spray does not cause sufficient pressure to be built up for switching, so that water can get into the intake system and impair engine function.

SUMMARY OF THE INVENTION

It is an object of the invention to provide an intake system that can be integrated into a small installation space.

Another object of the invention is to provide an air intake system which can prevent entry of snow, road spray or splashes of water into the intake tract.

These and other objects are achieved by the invention as described and claimed hereinafter.

The intake system according to the invention for an internal combustion engine of a motor vehicle has a first unfiltered air intake and a second unfiltered air intake. The two unfiltered air intakes are combined into a common line, which communicates with the internal combustion engine. The two unfiltered air intakes may also be joined directly in front of the internal combustion engine, so that each unfiltered air intake has its own components, e.g., its own filter element. Each unfiltered air intake consists of an opening through which air can flow into the intake system, and a line segment, which connects said opening with the line. The unfiltered air intakes can be sealed by one or several sealing elements, so that the air will flow either through the first unfiltered air intake or through the second unfiltered air intake into the line communicating with the internal combustion engine. The sealing element seals the respective air intake completely, so that air can flow into the line only through the unsealed unfiltered air intake. The sealing element can, for instance, be formed by a rotary body provided with corresponding openings. This rotary body unblocks the first unfiltered air intake in one end position and seals the first unfiltered air intake in a second end position.

The line communicating with the internal combustion engine guides the inflowing air either directly or indirectly to the internal combustion engine. If the air is indirectly guided to the internal combustion engine, the air can be pretreated, e.g., dried or cooled. If the air is directly guided to the internal combustion engine, no further component is required in the line.

The first unfiltered air intake is arranged in the motor vehicle at a location that is advantageous for air intake. A preferred location is the front area, since the air is pressed into the unfiltered air intake as a function of the vehicle speed, which improves the filling ratio of the cylinders. Furthermore, the air sucked into the front area is cooler than the air present in the engine compartment. In the front area, however, snow, ice, road spray and splashes or gushes of water can get into the first unfiltered air intake. Road spray is defined as air mixed with water droplets of any size. Road spray can, for instance, be splashed up from the road by a vehicle traveling ahead or be produced by rain. The term floodwater describes a larger amount of water, which occurs, for example, in the form of a surge when a river is crossed. The second unfiltered air intake is arranged at a location in the motor vehicle, which is unfavorable for air intake but is protected from road spray and splashes or gushes of water. Preferred locations for arranging this second unfiltered air intake can for instance be the engine compartment or the ventilation system.

To actuate the sealing element or valve member, an actuator is provided, which is connected to a control element. This actuating mechanism can, for instance, be an electric motor or a vacuum unit and can be actuated by means of the control element. The actuator executes a rotary or linear movement, which moves the sealing element into an end position and thereby either seals the first or the second unfiltered air intake. The control element is formed by a moisture sensor, which is equipped with a signal output to control the actuating mechanism. The moisture sensor can of course also be used for control.

The moisture sensor can be adjusted in such a way that it emits a signal to the actuating mechanism even in the presence of road spray, which already impairs the function of the internal combustion engine. This signal causes the first unfiltered air intake to be closed. In another adjustment of the moisture sensor, the signal to close the first unfiltered air intake is emitted only if the moisture sensor is surrounded by water. The signal of the moisture sensor can be transmitted to the actuating mechanism either directly or via an electronic unit, e.g., the engine control. As soon as the first unfiltered air intake is sealed by the sealing element, the second unfiltered air intake is opened, so that the internal combustion engine receives combustion air that is sucked in through the second unfiltered air intake.

In one advantageous embodiment of the invention, the valve member is a flap. The flap may, for instance, be circular, oval or rectangular, so that it blocks the second unfiltered air intake in a first position and the first unfiltered air intake in a second position. The flap may be arranged centrally on a flap shaft and moved by a rotary motion of the flap shaft. In other embodiments, the flap shaft is arranged in an edge area and thus permits an unfiltered air intake without interfering contours. To prevent water from penetrating into the first unfiltered air intake, particularly in case of immersion into a body of water, the flap may be provided with a circumferential seal. Also feasible are embodiments in which a first flap is arranged in the first unfiltered air intake and a second flap in the second unfiltered air intake, said two flaps communicating with one another. As soon as the first flap changes its position, the second flap is also moved, so that one unfiltered air intake is always open while the other unfiltered air intake is closed. The flaps can communicate mechanically, e.g., by means of a strut, or electronically by means of a signal emitted particularly by the moisture sensor.

According to one specific embodiment, the flap has two flap parts correspondingly connected with one another. These flap parts can be arranged at a defined angle contacting one another directly or they can be rigidly connected by means of connecting elements. A parallel mutual arrangement of the flap parts represents a special embodiment. However, the flap parts can also be spatially separate from one another so that they correspond with one another only via the actuating mechanism. The flap parts can, for instance, have a circular, oval or rectangular cross section, with one flap part sealing one unfiltered air intake. The flap parts can have a circumferential seal, by means of which the unfiltered air intakes can be tightly closed. If flap parts are used to seal the unfiltered air intakes, said unfiltered air intakes can open out into the common line in a variety of ways.

In another advantageous embodiment, the actuating mechanism is a lifting magnet, which communicates with the moisture sensor. The lifting magnet can execute an axial or a radial movement to move the sealing element. As soon as the moisture sensor detects water, it sends a signal to the lifting magnet causing a movement of the lifting magnet and thus a change in position of the sealing element. The lifting magnet responds to the signal within a few fractions of a second, so that the first unfiltered air intake is sealed before water can penetrate and reach the internal combustion engine. As is well known, lifting magnets have an armature, a spring, a coil, a yoke and an electrical connection.

In another specific embodiment of the invention, the moisture sensor is arranged in the same plane as the first unfiltered air intake. It may be arranged at a point remote from the unfiltered air intake, which primarily comes into contact with water. The sealing element is disposed above the moisture sensor at a defined distance to allow sufficient response time between detection of water and closing of the first unfiltered air intake so that no water can penetrate. Preferably, the moisture sensor is arranged at a location within the engine compartment. This causes the moisture sensor to detect the environmental conditions inside the engine compartment. During travel through water, the moisture sensor dips into the standing water at the same time as the unfiltered air intake and immediately causes the first unfiltered air intake to be closed by the sealing element, which is arranged at a higher level. Arranging the moisture sensor in the same plane as the first unfiltered air intake makes it possible to prevent a premature closure of the first unfiltered air intake, which would occur if the moisture sensor were arranged on a lower level.

Another embodiment of the invention provides that the moisture sensor is arranged in the first unfiltered air intake. The moisture sensor thus detects precisely the conditions prevailing in the first unfiltered air intake. It causes the first unfiltered air intake to be closed by the sealing element as soon as water penetrates into the first unfiltered air intake. The sealing element is arranged downstream from the moisture sensor. The distance between the sealing element and the moisture sensor is selected in such a way that once water has been detected, there is still sufficient response time to seal the first unfiltered air intake before the water flows past the sealing element and reaches the internal combustion engine. By arranging the moisture sensor in the first unfiltered air intake, said first unfiltered air intake is closed only if water actually enters the first unfiltered air intake. In other words, the air is sucked in through the first unfiltered air intake, which is more favorable for the internal combustion engine, and only if water actually penetrates into the first unfiltered air intake, the first unfiltered air intake is closed and the air is sucked in through the second unfiltered air intake.

According to another advantageous embodiment of the invention, the moisture sensor can be heated. For example, resistance heating can be used for this purpose. It is also feasible, however, to use the heat from adjacent components to heat the moisture sensor. By heating the moisture sensor it is possible, for example, to melt any snow or ice. Heating the moisture sensor can also be used to evaporate any adhering water droplets.

An advantageous embodiment of the invention provides for a moisture sensor that is configured as a conductivity sensor with two electrodes. When the electrodes come into contact with water, the conductivity of the sensor changes. The configuration of the conductivity sensor, particularly the distance between the electrodes, should be selected as a function of the switching conditions, i.e., when the first unfiltered air intake should be closed and when the second unfiltered air intake should be opened. The smaller the distance between the electrodes, the sooner the electrodes are connected, for instance, by a single drop of water. This causes the conductivity sensor to emit a signal and the actuating mechanism to close the first unfiltered air intake. If the distance between the electrodes is large, a single water drop is not sufficient to connect the electrodes. Only after both electrodes have for instance been submerged in a ford, the conductivity sensor emits the signal to close the first unfiltered air intake. In one embodiment, the conductivity sensor is, for example, equipped with two electrodes, which are separated by an insulating layer consisting, for example, of air, plastic or ceramic. As soon as there is water on the insulating layer, which bridges said layer, the electrodes are conductively connected with one another, whereby the sensor signal is generated and the sealing element is moved to its second position by means of the actuating mechanism. Depending on how wide the insulating layer is, the moisture sensor responds either to individual droplets in case of road spray or only when the electrodes are completely surrounded by water, in case of splashes or floodwater.

It is advantageous that the moisture sensor is formed by at least two electrically conductive wires, which are spaced at a distance from one another. The electrically conductive wires are made of a material that has little electrical resistance and is thus a good electrical conductor, e.g., metals or metal alloys. The wires, which are spaced at a distance from one another, can extend parallel or at an angle to one another.

According to a further embodiment of the invention, the electrically conductive wires are applied to a substrate. They may be embedded in the substrate or be supported on the substrate. The substrate is made of a material that insulates the conductive wires when dry. This material can be made water absorbent and then becomes electrically conductive. In another embodiment of the substrate, the substrate material is not water absorbent, so that the water is deposited in the form of droplets on the substrate. Such a water droplet bridges the electrically insulating substrate material and connects the wires so that a current flow is created, which causes the first unfiltered air intake to be closed.

In another embodiment of the invention, the moisture sensor is a capacitance sensor with two capacitor plates spaced at a distance from one another. The capacitor plates are connected to an AC voltage source, so that an electrical field with a defined field strength is produced. The field strength, as is well known, is a function of the applied voltage and the distance between the capacitor plates. The farther apart the capacitor plates are spaced from one another the weaker the electrical field. The capacity of the capacitors is a function of the area and the distance between the capacitor plates as well as the relative permittivity of the material between the capacitor plates.

The capacitor plates are made of an electrically conductive material, e.g., metal. This electrically conductive material may be provided with a protective layer of a non-conductive material, e.g., synthetic resin material. The protective layer can, for instance, serve for corrosion protection and enclose the capacitor plates completely, so that the capacitor plates do not come into direct contact with water or air. The capacitor plates are connected to an evaluator unit in which the electrical field between the capacitor plates is evaluated. The evaluator unit measures the capacity of the capacitor plates with a high-frequency AC voltage. The relative permittivity of air equals approximately 1 while that of water is approximately 80. As soon as water instead of air is sucked in, the relative permittivity between the capacitor plates is substantially changed. This causes the evaluator unit to send a signal to the actuating mechanism and the first unfiltered air intake to be closed by the valve member.

The capacitance sensor can be adjusted in such a way that it responds only to floodwater, i.e., only to a substantial change in the relative permittivity between the capacitor plates. In another adjustment, a slight change in the relative permittivity can already be sufficient to close the first unfiltered air intake.

The capacitor plates can be arranged at any location in the vehicle, either parallel or in mirror image to one another. In preferred embodiments, the capacitance sensor is arranged on the first unfiltered air intake. The capacitor plates are semicircular and can enclose the first unfiltered air intake. With a capacitance sensor, the medium being sucked in can be reliably determined. In addition, capacitance sensors are insensitive to dirt.

In another advantageous embodiment of the invention, the capacitance sensor has a concentric configuration. The capacitor plates are cylindrical, with an outer capacitor plate surrounding an inner capacitor plate. This concentrically configured capacitance sensor can be disposed directly in the first unfiltered air intake, where the contour of the outer capacitor plate corresponds to the inner contour of the first unfiltered air intake. To fix the inner capacitor plate within the outer capacitor plate, one or several segments may be provided. These segments affect the flow of the intake air only to a very minor extent. Furthermore, the segments can be made of an electrically insulating material, particularly the same material as the protective layer of the capacitor plates. Using a concentric configuration of the capacitance sensor creates a stable field between the capacitor plates, so that the capacitance sensor is not susceptible to interference.

In a further embodiment of the capacitance sensor, the capacitor plates extend within the first unfiltered air intake at an angle to one another. Each capacitor plate on the one hand contacts the first line segment and on the other hand is centrally fixed inside the first unfiltered air segment. In this embodiment, the angle is preferably 90°. As a result, four electrical fields are produced and evaluated.

One advantageous embodiment of the invention provides for the arrangement of several moisture sensors. For instance, two identical moisture sensors may be provided, which may be arranged at different locations inside the engine compartment. A switching logic can thereby be established. Furthermore, moisture sensors with different modes of action or sensitivities may be combined. The moisture sensors may be arranged directly side by side or in different locations on the vehicle. In one possible arrangement, a highly sensitive moisture sensor is disposed in the first unfiltered air intake and a less sensitive moisture sensor in the engine compartment below the first unfiltered air intake. This makes it possible to configure different switching variants. As soon as the less sensitive moisture sensor is submerged in water, it can emit a signal to close the first unfiltered air channel, even though the highly sensitive moisture sensor has not yet made contact with water. In a further variant, both moisture sensors come into contact with road spray, whereby the less sensitive moisture sensor does not yet emit a signal, but the highly sensitive moisture sensor emits the signal to close the sealing element.

It is advantageous if the operability of the moisture sensor can be tested upon start of the internal combustion engine. As soon as the engine is started, a sensor test checks the operability of the moisture sensor to ensure that the moisture sensor will actually work when required. To display the status of the moisture sensor to the operator of the internal combustion engine, the moisture sensor can be connected, for example, to an indicator light. If the sensor works properly the light is extinguished after the sensor test is completed. If the sensor test is negative, i.e., the moisture sensor does not work as specified, the indicator light may blink or be on continuously. This informs the operator that the intake system does not operate properly and that the first unfiltered air intake may not close in case of water, so that travel through water should be avoided and the intake system should be repaired as soon as possible.

In a specific embodiment of the inventive concept, the operability of the actuating mechanism and the sealing element can be checked upon start of the internal combustion engine. The actuating mechanism and the sealing element are moved each time the internal combustion engine is started to ensure that all parts are operable when required and have not been frozen, e.g., due to corrosion. Testing of the actuating mechanism and the sealing element can be indicated, for instance, by means of a control indicator, such as a warning light, which is extinguished only after successful movement.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
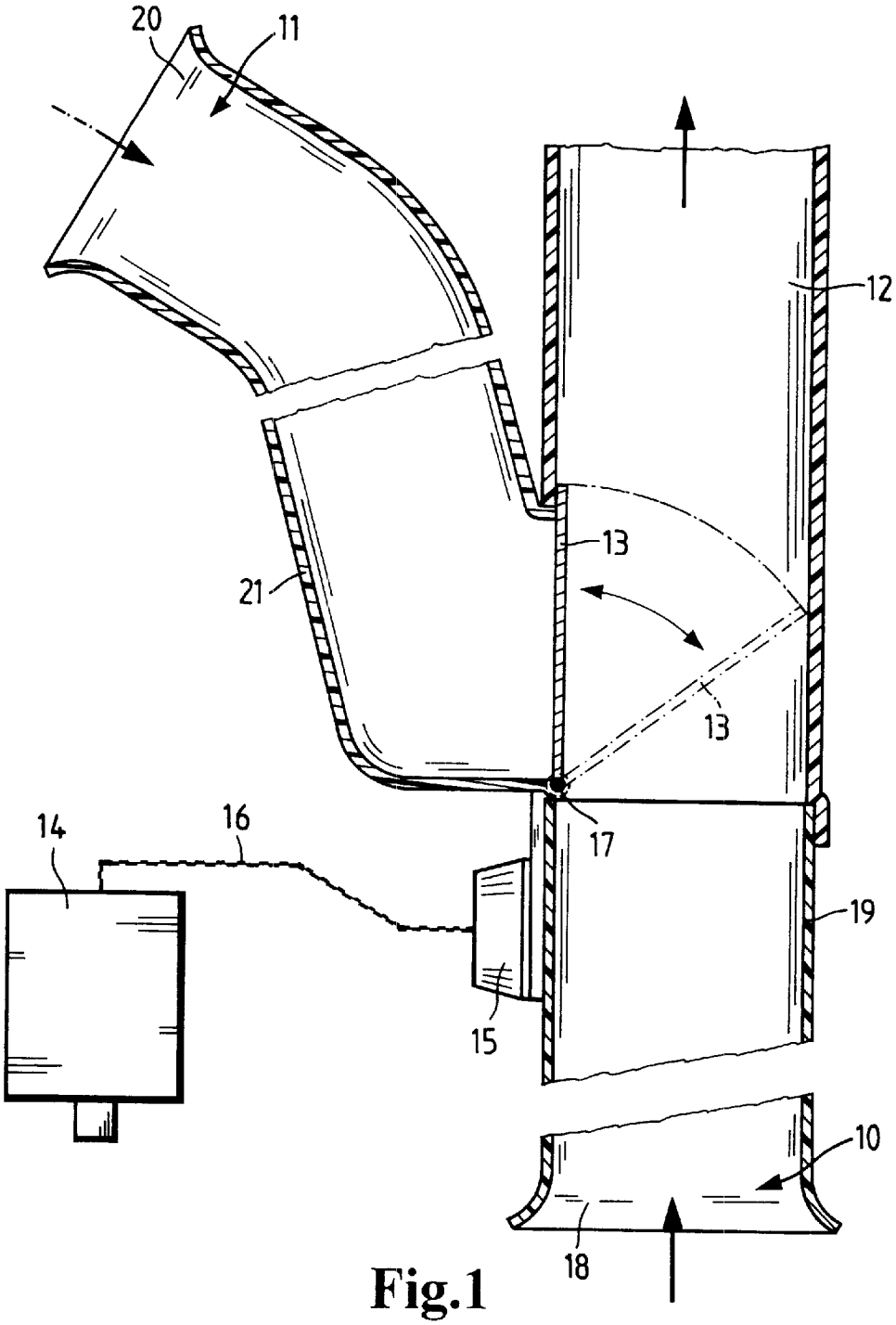
FIG. 1 shows an intake system according to the invention.

FIG. 1 is a schematic illustration of an intake system. This intake system comprises a first unfiltered air intake 10 and a second unfiltered air intake 11. The unfiltered air intakes 10 and 11 open into a common line 12, which leads to an internal combustion engine (not shown). The first unfiltered air intake 10 is designed as a separate component, which is sealingly connected to line 12. In other embodiments, the first and the second unfiltered air intakes 10 and 11 may form a single part together with line 12. The intake system has a flap 13, which depending on its position seals off the first unfiltered air intake 10 or the second unfiltered air intake 11.

In a first position, flap 13 closes off the second unfiltered air intake 11, so that the incoming air enters the intake system through the first unfiltered air intake 10 and is supplied to the internal combustion engine. This first position is the basic position, since the first unfiltered air intake 10 creates the more favorable conditions for the internal combustion engine. A deviation from this first position occurs only if water or snow enters the intake system through the first unfiltered air intake 10.

To detect whether water or snow is entering the intake system, a moisture sensor 14 is provided, which is connected to a vacuum unit 15. As soon as the moisture sensor 14, which is constructed as a conductivity sensor, comes into contact with water or snow, its conductivity changes and a signal is sent from the moisture sensor 14 via a connecting line 16 to the vacuum unit 15. As a result of the signal, the vacuum unit 15 produces a movement by means of which the flap 13 is moved into a second position (shown in broken lines). In this second position, the first unfiltered air intake 10 is closed and the second unfiltered air intake 11 is open. The flap 13, which is provided with a pivot shaft 17 is connected to vacuum unit 15 so that the flap shaft 17 is rotated and as a result the flap 13 is moved from its first position into its second position (shown in broken lines).

The first unfiltered air intake 10 is defined by a first opening 18 and a first line segment 19 adjacent to said first opening 18. The moisture sensor 14 is arranged in such a way that no water will pass through flap 13 and enter line 12. The second unfiltered air intake 11 is defined by a second opening 20 and a second line segment 21. This second opening 20 is arranged at a location in the vehicle that is protected from road spray and splashes and is located above the first opening 18. The line segments 19 and 21 can follow any desired three-dimensional curves within the vehicle, so that the intake system can be adapted to the engine compartment.

Figure 2:
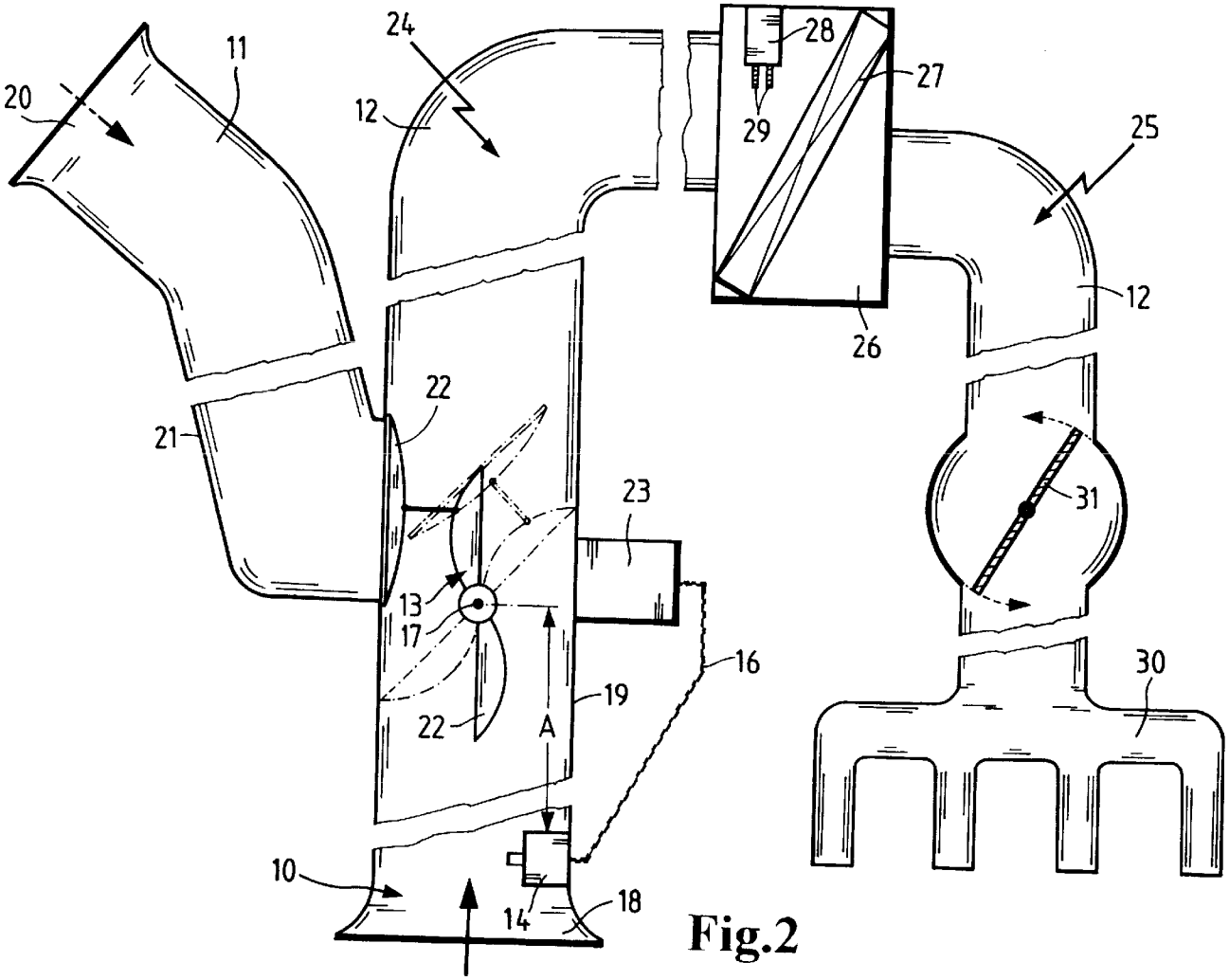
FIG. 2 shows a further embodiment of an intake system according to the invention.

FIG. 2 shows a variant of the intake system. Components that correspond to those shown in FIG. 1 are provided with identical reference numbers. In this example, the moisture sensor 14 is arranged in the first unfiltered air intake 10 in the area of the first opening 18. The flap 13 for closing the first unfiltered air intake 10 is arranged spaced a defined distance A from the moisture sensor 14 in the first line segment 19. The distance A is determined in such a way that the water, during the response time between water detection by the moisture sensor 14 and closing of the first unfiltered air intake 10, can continue to penetrate into the first unfiltered air intake 10 without reaching line 12, which communicates with the internal combustion engine. By the time the water reaches flap 13, which forms the junction to line 12, flap 13 must be closed, i.e., in the second position (shown in broken lines), in which flap 13 closes off the first unfiltered air intake 10. Thus, the water can advance at maximum up to flap 13, but cannot get into line 12.

In this illustrative embodiment, flap 13 has two flap parts 22, which are rigidly connected with one another. In the first position one of the flap parts 22 closes off the second unfiltered air intake 1.1. In the second position (shown in broken lines) the other flap part 22 closes off the first unfiltered air intake 10 while the second unfiltered air intake 11 is unblocked. Flap 13 is moved by a lifting magnet 23 (In the drawing the lifting magnet is shown displaced by 90° around the circumference of tube 19).

Line 12 has an unfiltered area 24 and a filtered area 25. Between this unfiltered area 24 and the filtered area 25 there is a filter housing 26 in which a filter element 27 is inserted while forming a seal. As a result, the filtered area 25 is sealed off from the unfiltered area 24. Furthermore, in filter housing 26 there is a second moisture sensor 28, which monitors the intake air in the filter housing 26. This second moisture sensor 28 is a conductivity sensor with two electrodes 29 arranged parallel to one another. As soon as this second moisture sensor 28, which is more sensitive to moisture, e.g., road spray, than the first moisture sensor 14, generates a signal which indicates that water has penetrated into the filter housing 26, the lifting magnet 23 can likewise be actuated, so that the first unfiltered air intake 10 is closed by flap 13.

In the filtered area 25, the air filtered by filter element 27 is supplied to an air intake manifold 30 of line 12. The air supply to the intake manifold 30 can be regulated by a throttle valve 31 depending on the operating state of the internal combustion engine.

Figure 3:
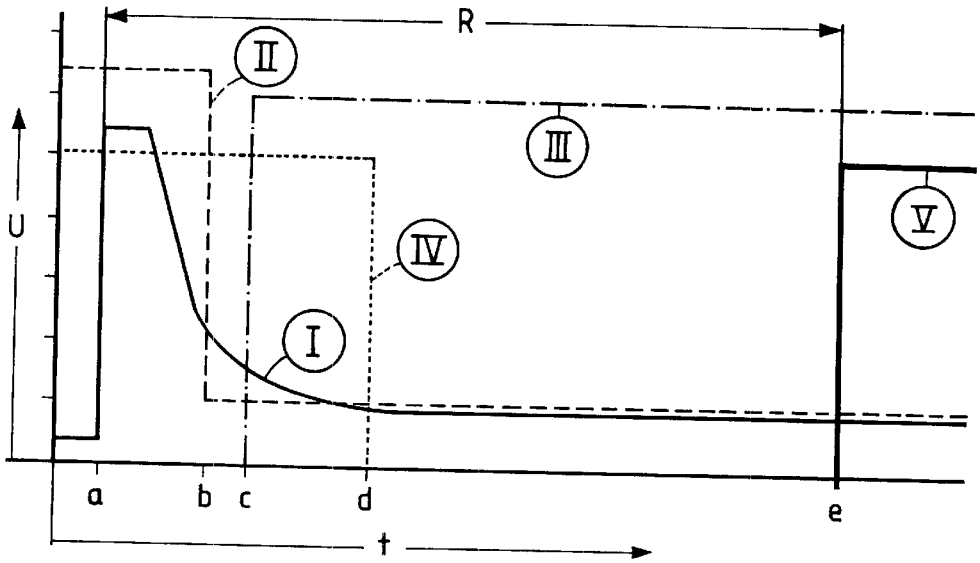
FIG. 3 is an operating diagram.
Figure 4:
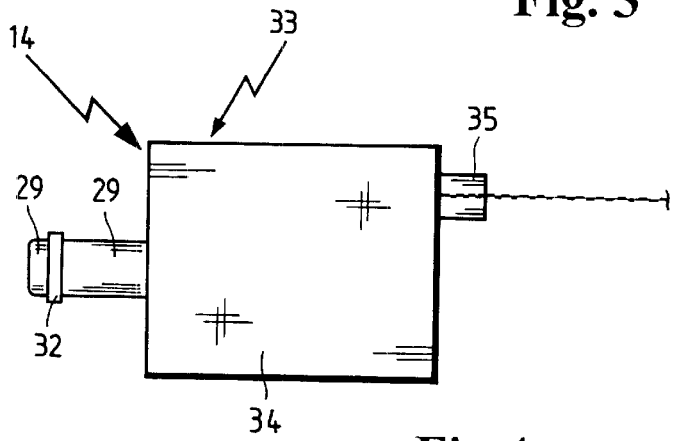
FIG. 4 shows a conductivity sensor.

FIG. 3 shows an operating diagram which depicts the time sequence from detection of water in the intake system. The time axis extends horizontally and the voltage axis vertically. The operating diagram shows five curves. Curve I describes the voltage characteristic of the moisture sensor 14, curve II represents the switching signal of the moisture sensor 14, curve III corresponds to the control signal of the actuating mechanism, curve IV describes the movement of the actuating mechanism, and curve V indicates the position of the flap 13. As long as no water comes into contact with the moisture sensor 14 (e.g., as shown in FIGS. 1, 2, 4), flap 13 (as shown in FIGS. 1, 2) is in its first position. At (a) the moisture sensor 14 has come into contact with water causing its voltage to be changed. This voltage change generates a switching signal (b) which is forwarded through the signal output of the moisture sensor 14 to the actuating mechanism. At (c) the control signal for the movement of the actuating mechanism is generated, and at (d) the movement of the actuating mechanism starts. This movement is completed at (e), when the flap 13 completely closes off the first unfiltered air intake 10. From water detection (a) until the first unfiltered air intake 10 is sealed at (e), a response time R elapses, which is shorter than one second. If fast components are used, response times of a few milliseconds can be realized, so that even small distances A between the moisture sensor 14 and the flap 13 are sufficient to prevent water from penetrating into line 12.

FIG. 4 depicts a moisture sensor 14, which is constructed as a conductivity sensor. This conductivity sensor comprises two electrodes 29, which are separated by insulation 32. The moisture sensor 14 furthermore has an electronic evaluation unit 33, which is integrated into a sensor housing 34. Signals from the electronic evaluation unit 33 can be supplied to flap 13 (according to FIG. 1 or 2) via a signal output 35.

As soon as the annular insulation 32 is at least partially surrounded by water, the electrodes 29 are conductively connected with one another. If only a small water droplet bridges insulation 32, the conductivity of moisture sensor 14 changes less than if moisture sensor 14 is completely surrounded by water. Thus, the moisture sensor can be adjusted in such a way that the first unfiltered air intake 10 (not shown) will be closed even as a result of road spray or only in response to a gush of water.

Figure 5:
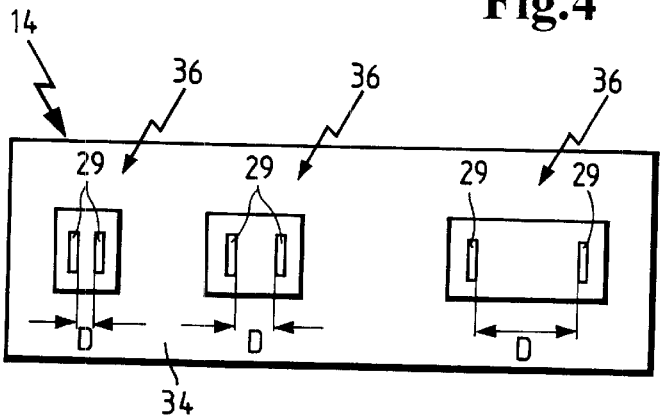
FIG. 5 depicts a moisture sensor with a plurality of electrodes.

FIG. 5 shows a moisture sensor 14 with several electrodes 29. In this embodiment, the moisture sensor 14 has three electrode pairs 36 with different spacings D between the electrodes. Electrodes 29 are insulated from one another exclusively by air. As soon as water bridges distance D between the electrodes, water is detected. All three electrode pairs 36 are arranged in the same sensor housing 34. The values of the three electrode pairs 36 are processed, based on a switching logic, in the same electronic evaluation unit 33, which is arranged in the sensor housing 34. If the first electrode pair 36, which has the smallest distance D between the electrodes, detects water while the other two electrode pairs 36 do not detect any water, only road spray is present. If all three electrode pairs 36 detect water, splashes or even floodwater may be present, e.g., as may occur when fording a stream. Depending on when the first unfiltered air intake (according to one of FIGS. 1 or 2) is to be closed, the results of the electrode pairs 36 must be correlated with each other and an appropriate output signal transmitted to the actuating mechanism.

Figure 6:
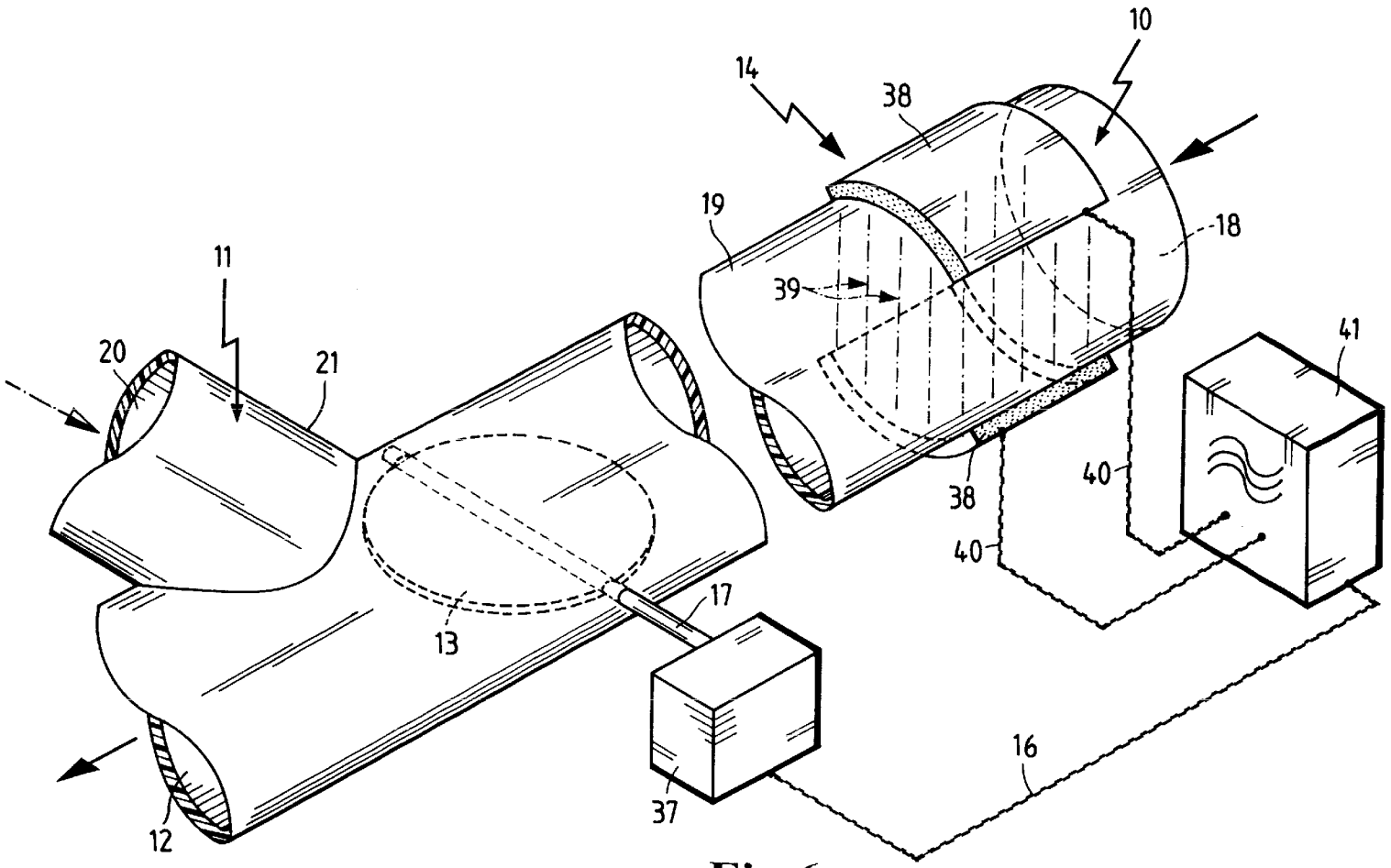
FIG. 6 shows an intake system with a capacitance sensor.

FIG. 6 is a perspective view of an intake system. The intake system has a first unfiltered air intake 10, a second unfiltered air intake 11 and a line 12, which communicates with an internal combustion engine (not shown). The first unfiltered air intake 10 has a first opening 18 through which air can flow into the intake system and a first line segment 19, which connects the first opening 18 with line 12. The second unfiltered air intake 11 has a second opening 20 and a second line segment 21. This second line segment 21 connects the second opening 20 with line 12. The cross section of the second unfiltered air intake 11 is smaller than the cross section of the first unfiltered air intake 10. Consequently, the second unfiltered air intake 11 does not need to be closeable. The air is always sucked in through the intake with the least air resistance, so that even if the second air intake 11 is not closed, the air is sucked in through the open first unfiltered air intake 10. Only if the first unfiltered air intake 10 is closed, is the air sucked in through the second unfiltered air intake 11. In this illustrative embodiment, the first unfiltered air intake 10 is constructed in one piece with and merges seamlessly into line 12. To separate line 12 from the first unfiltered air intake 10, a flap 13 arranged on a flap shaft 17 is provided. Flap shaft 17 is connected to a rotary flap actuator 37, which rotates flap shaft 17. The second unfiltered air intake 11 opens into line 12 behind flap 13 as seen in flow direction.

A moisture sensor 14 formed by two capacitor plates 38 is arranged on unfiltered air intake 10. The capacitor plates 38 are curved and axially and radially enclose a partial area of the first line segment 19. Moreover, capacitor plates 38 are disposed opposite one another, so that an electrical field 39 is produced. The two capacitor plates 38 each have a voltage connection 40. The voltage connections 40 are connected to an evaluator unit 41. In the evaluator unit 41, the electrical field 39 produced by the capacitor plates 38 is evaluated. As soon as water penetrates into the first unfiltered air intake 10, the electrical field 39 changes, and the evaluator unit 41 outputs a signal. This signal is routed via a connecting line 16 to the rotary flap actuator 37 and causes the rotary flap actuator 37 to move, which in turn moves flap 13 to its closed position (not shown). The evaluator unit 41 uses a higher-frequency AC voltage, particularly an AC voltage ranging from 10–50 kHz, to measure the complex resistance of the electrical field 39.

Figure 7:
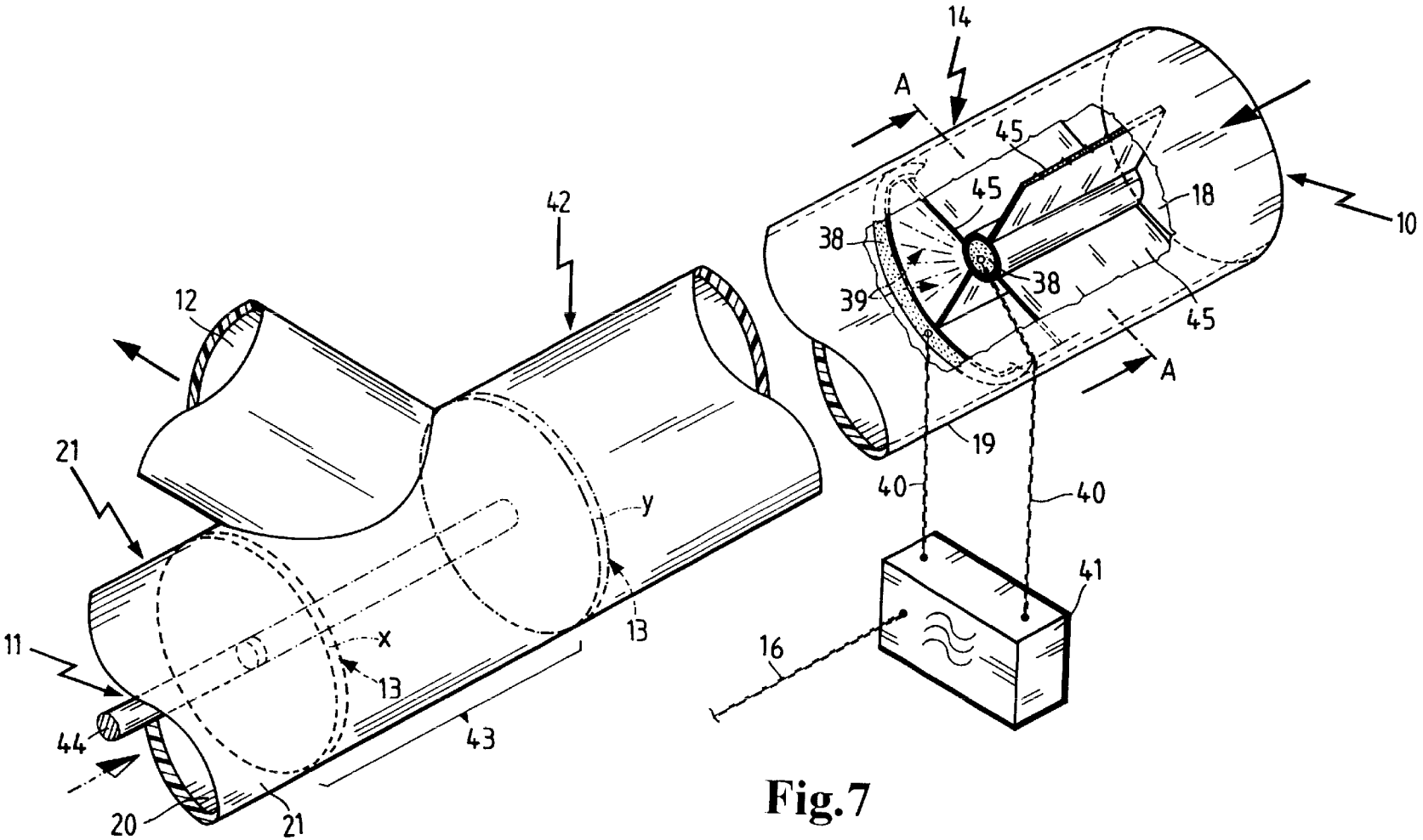
FIG. 7 shows an intake system with a capacitance sensor.

FIG. 7 is a perspective view of an intake system. Components corresponding to those shown in FIG. 6 are identified by the same reference numerals. In this embodiment, the first unfiltered air intake 10 and the second unfiltered air intake 11 are designed as a single piece. The unfiltered air intakes 10, 11 are formed by a pipe 42, in which on the one hand the first unfiltered air intake 10 with its first opening 18 and on the other hand the second unfiltered air intake 11 with its second opening 20 are arranged. Line 12, which communicates with an internal combustion engine (not shown), opens into this pipe 42 in an adjustment range 43. This adjustment range 43 is defined by the two end positions of flap 13. The flap 13 is inserted into pipe 42 to form a seal. In the first end position (position x, shown by dashed lines), flap 13 closes off the second unfiltered air intake 11, so that only air entering the intake system through the first unfiltered air intake 10 can pass into line 12. In the second end position (position y, shown by dash-dotted lines) flap 13 closes off the first unfiltered air intake 10, so that only air sucked in through the second unfiltered air intake 11 reaches line 12. The flap 13 is constructed as a slide valve, so that a linear movement is required to move the flap position. To this end, a connecting rod 44 is connected on the one hand with flap 13 and on the other hand with an actuating mechanism (not shown). The actuating mechanism may, for example, comprise a lifting magnet or an electric motor.

In this embodiment, the moisture sensor 14, which is arranged in the first unfiltered air intake 10, is formed by two concentrically arranged capacitor plates 38. The first capacitor plate 38 is configured as a hollow cylinder, the outside of which fits against the first line segment 19. The first capacitor plate 38 furthermore encloses the second capacitor plate 38, which is cylindrical. To fix the second capacitor plate 38 inside the first capacitor plate 38, segments 45 arranged at a 90° angle to one another are provided. Segments 45 are at least partially made of an electrically insulating material, so that no charge exchange can take place between the capacitor plates 38. The two capacitor plates 38 each have a voltage connection 40 by means of which they are connected to the evaluator unit 41. The electrical field 39 produced between the first capacitor plate 38 and the second capacitor plate 38 is evaluated in the evaluator unit 41. As soon as water enters the first unfiltered air intake 10, the electrical field 39 between the two capacitor plates 38 changes. This causes the evaluator unit 41 to send a signal via connecting line 16 to the actuating mechanism (not shown) so that flap 13 is moved and closes off the first unfiltered air intake 10, and at the same time opening communication between the second air intake 11 and. line 12.

Figure 8:
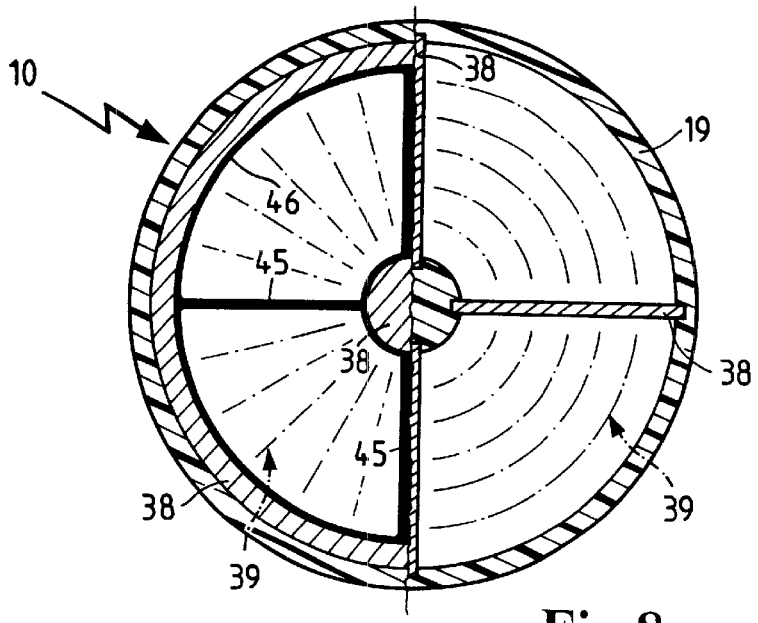
FIG. 8 is a sectional view taken along section line A—A in FIG. 7.

FIG. 8 is a sectional view taken along line A—A in FIG. 7. The left and right halves of the figure illustrate different embodiments.

In the left half of the figure, the first capacitor plate 38 is circular in cross section. It is made of metal and directly fits against the inner wall of first line segment 19, which is made of synthetic resin material. The second capacitor plate 38 is circular in its cross section and is arranged within the first capacitor plate 38 with the aid of segments 45, which are made of electrically non-conductive synthetic resin material. Segments 45 are dimensioned in such a way that they form the least possible flow resistance but nevertheless fix the second capacitor plate 38 in its central position. The two capacitor plates 38 are covered with an insulating layer 46 made of synthetic resin material. In this embodiment, the insulating layer 46 is integral with the segments 45, which fix the second capacitor plate 38 in position.

In the right half of the figure, the capacitor plates 38 are arranged at a 90° angle to one another. All the capacitor plates 38 are connected with the first line segment 19 and are centrally fixed in insulating manner inside the first unfiltered air intake 10. The electrical field 39 is produced between the angled capacitor plates 38.

Figure 9:
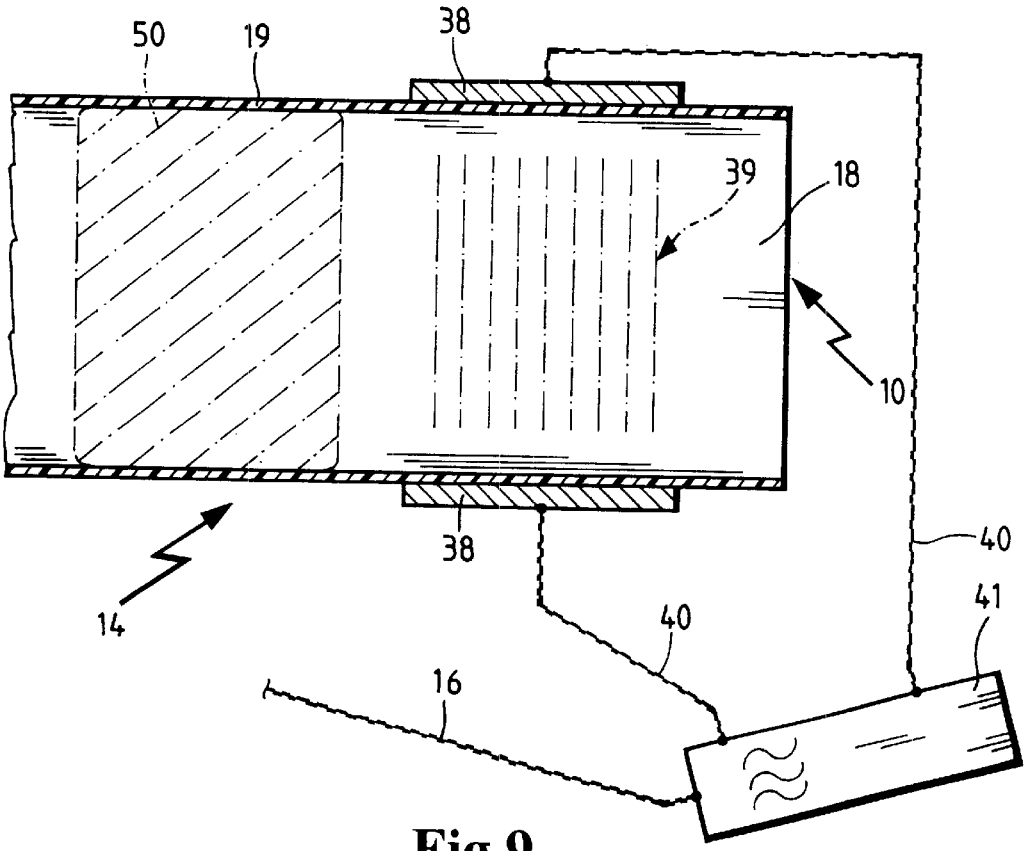
FIG. 9 is a detail view of an intake system according to the invention.

FIG. 9 depicts a detail of an intake system. Components corresponding to those shown in FIG. 6 are identified by the same reference numerals. In this example, the first unfiltered intake 10 has a rectangular cross section 50. The capacitor plates 38 are arranged parallel to one another outside the first line segment 19, so that the electrical field 39 is simple to evaluate.

The foregoing description and examples have been set forth merely to illustrate the invention and are not intended to be limiting, since modifications of the described embodiments incorporating the spirit and substance of the invention may occur to persons skilled in the art, the invention should be construed broadly to include all variations falling within the scope of the appended claims and equivalents thereof.

What is claimed is:

1. An intake system for an internal combustion engine of a motor vehicle, comprising a first air intake, a second air intake, a valve member movable between first and second positions, an actuator which moves the valve member, and a controller which actuates the actuator, wherein the second air intake is arranged at a location protected against road spray and splashes of water, the first air intake and the second air intake each open into a common line leading to the internal combustion engine, the second air intake is blocked when the valve member is in the first position, and the first air intake is blocked when the valve member is in the second position; said control element comprising a moisture sensor which outputs a signal to control the actuator.

2. An air intake system according to claim 1, wherein the moisture sensor is arranged in the same plane as the first air intake.

3. An air intake system according to claim 1, wherein the moisture sensor is arranged inside the first air intake.

4. An air intake system according to claim 1, wherein the moisture sensor is heated.

5. An air intake system according to claim 1, wherein the moisture sensor is a conductivity sensor.

6. An air intake system according to claim 1, wherein the moisture sensor is comprised by at least two spaced electrodes.

7. An air intake system according to claim 6, wherein the electrodes are mounted on a support.

8. An air intake system according to claim 1, wherein the moisture sensor is comprised by a capacitance sensor.

9. An air intake system according to claim 8, wherein the capacitance sensor comprises concentrically arranged capacitor elements.

10. An air intake system according to claim 1, wherein a plurality of moisture sensors are provided.

11. An air intake system according to claim 1, wherein the operability of the moisture sensor can be tested upon start-up of the internal combustion engine.

12. An air intake system according to claim 1, wherein the operability of the actuator and the valve member can be tested upon start-up of the internal combustion engine.

* * * * *